US006876157B2

(12) United States Patent
Henry

(10) Patent No.: US 6,876,157 B2
(45) Date of Patent: Apr. 5, 2005

(54) LAMP INVERTER WITH PRE-REGULATOR

(75) Inventor: George C. Henry, Simi Valley, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

(21) Appl. No.: 10/463,289

(22) Filed: Jun. 17, 2003

(65) Prior Publication Data

US 2004/0056607 A1 Mar. 25, 2004

Related U.S. Application Data

(60) Provisional application No. 60/389,618, filed on Jun. 18, 2002, and provisional application No. 60/392,333, filed on Jun. 27, 2002.

(51) Int. Cl.[7] ..... H05B 37/02; H05B 41/16

(52) U.S. Cl. ..... 315/219; 315/291; 315/283; 315/307; 315/DIG. 7

(58) Field of Search ..... 315/219, 291, 315/307, 283, 106, 284, 290, DIG. 7; 323/222, 285

(56) References Cited

U.S. PATENT DOCUMENTS

| | | | | |
|---|---|---|---|---|
| 4,060,751 A | | 11/1977 | Anderson | 315/209 R |
| 4,622,496 A | * | 11/1986 | Dattilo et al. | 315/283 |
| 4,672,300 A | * | 6/1987 | Harper | 323/222 |
| 5,434,477 A | | 7/1995 | Crouse et al. | 315/209 R |
| 5,539,281 A | | 7/1996 | Shackle et al. | 315/224 |
| 5,652,479 A | | 7/1997 | LoCascio et al. | 525/57 |
| 5,818,172 A | | 10/1998 | Lee | 315/86 |
| 5,825,133 A | | 10/1998 | Conway | 315/105 |
| 5,923,129 A | | 7/1999 | Henry | 315/307 |
| 5,930,121 A | | 7/1999 | Henry | 363/16 |
| 6,002,210 A | | 12/1999 | Nilssen | 315/219 |
| 6,038,149 A | | 3/2000 | Hiraoka et al. | 363/37 |
| 6,040,662 A | | 3/2000 | Asayama | 315/291 |
| 6,108,215 A | | 8/2000 | Kates et al. | 363/17 |
| 6,121,733 A | | 9/2000 | Nilssen | 315/224 |
| 6,137,240 A | | 10/2000 | Bogdan | 315/307 |
| 6,150,772 A | | 11/2000 | Crane | 315/291 |
| 6,181,084 B1 | | 1/2001 | Lau | 315/291 |
| 6,198,234 B1 | | 3/2001 | Henry | 315/291 |
| 6,259,615 B1 | | 7/2001 | Lin | 363/98 |
| 6,281,636 B1 | | 8/2001 | Okutsu et al. | 315/209 R |
| 6,417,631 B1 | | 7/2002 | Chen et al. | 315/291 |
| 6,472,827 B1 | | 10/2002 | Nilssen | 315/209 R |
| 6,515,881 B2 | | 2/2003 | Chou et al. | 363/95 |
| 2001/0036096 A1 | | 11/2001 | Lin | |
| 2002/0145886 A1 | | 10/2002 | Stevens | |
| 2002/0171376 A1 | | 11/2002 | Rust et al. | |
| 2002/0180380 A1 | | 12/2002 | Lin | |
| 2002/0181260 A1 | | 12/2002 | Chou et al. | 363/95 |
| 2003/0090913 A1 | | 5/2003 | Che-Chen et al. | 363/21.12 |

OTHER PUBLICATIONS

Copy of copending U.S. Appl. No. 10/463,280 entitled Square Wave Drive System; filed Jun. 17, 2003.

* cited by examiner

*Primary Examiner*—Don Wong
*Assistant Examiner*—Chuc Tran
(74) *Attorney, Agent, or Firm*—Knobbe, Martens, Olson & Bear, LLP.

(57) ABSTRACT

An efficient power conversion circuit for driving a fluorescent lamp uses a pre-regulator to generate a regulated voltage with a relatively high level of ripple voltage. The regulated voltage can be varied to provide dimming of the fluorescent lamp. The regulated voltage is provided to a direct drive inverter. The direct drive inverter uses driving signals of fixed pulse widths to generate an output voltage to drive the fluorescent lamp. The output voltage has relatively long on-time durations so that the difference between the peak lamp current and the average lamp current is reduced, thus reducing a lamp current crest factor for improved lamp lighting efficiency.

21 Claims, 6 Drawing Sheets

LAMP INVERTER WITH PRE-REGULATOR

CLAIM FOR PRIORITY

This application claims the benefit of priority under 35 U.S.C. §119(e) of U.S. Provisional Application No. 60/389,618 entitled "Lamp Inverter with Pre-Regulator," filed on Jun. 18, 2002, and U.S. Provisional Application No. 60/392,333 entitled "Square Wave Drive System," filed on Jun. 27, 2002, the entirety of which are incorporated herein by reference.

RELATED APPLICATION

Applicant's copending U.S. patent application entitled "Square Wave Drive System," filed on the same day as this application, is hereby incorporated by reference herein.

BACKGROUND OF THE INVENTION

1. Field of the Invention

The present invention relates to a power conversion circuit for driving fluorescent lamps, such as, for example, cold cathode fluorescent lamps (CCFLs), and more particularly relates to a lamp inverter with a pre-regulator for improved efficient operation of the CCFLs.

2. Description of the Related Art

Fluorescent lamps are used in a number of applications where light is required but the power required to generate the light is limited. One particular type of fluorescent lamp is a cold cathode fluorescent lamp (CCFL). CCFLs are used for back lighting or edge lighting of liquid crystal displays (LCDs), which are typically used in notebook computers, web browsers, automotive and industrial instrumentation, and entertainment systems.

CCFL tubes typically contain a gas, such as Argon, Xenon, or the like, along with a small amount of Mercury. After an initial ignition stage and the formation of plasma, current flows through the tube, which results in the generation of ultraviolet light. The ultraviolet light in turn strikes a phosphorescent material coated in the inner wall of the tube, resulting in visible light.

A power conversion circuit is generally used for driving the CCFL. The power conversion circuit accepts a direct current (DC) input voltage and provides an alternating current (AC) output voltage to the CCFL. The brightness (or the light intensity) of the CCFL is controlled by controlling the current (i.e., the lamp current) through the CCFL. For example, the brightness of the CCFL is related to an average power provided to the CCFL. Thus, the brightness of the CCFL can be controlled by changing the amplitude of the lamp current (e.g., amplitude modulation) or by changing the duty cycle of the lamp current (e.g., pulse width modulation).

One type of power conversion circuit uses pulse width modulation techniques to drive the CCFL. The power conversion circuit varies the pulse widths (or the duty cycles) of one or more driving signals to control the average power provided to the CCFL. The pulse widths of the driving signals may be varied to compensate for variations in the input voltage or to achieve a desired brightness.

One problem with varying the pulse widths of the driving signals is that lamp efficiency may degrade. Lamp efficiency in terms of light output versus lamp current amplitude degrades with increasing lamp current crest factor. Lamp current crest factor is defined as a ratio of the peak lamp current level to the root mean square (RMS) lamp current level. Lamp current crest factor increases as the pulse widths of the driving signals are reduced from an optimum level. For example, lamp efficiency generally degrades as the pulse widths of the driving signals are reduced to dim the CCFL or to compensate for an increased in the input voltage.

Driving signals with shorter pulse widths decrease the duration that power is coupled to a secondary winding of a transformer in the power conversion circuit, resulting in less power provided to the CCFL for a given supply voltage. At the same time, the driving signals with shorter pulse widths decrease the effectiveness of signal filtering provided by the transformer's leakage inductance and output capacitance, resulting in a greater difference between the peak lamp current level and the RMS lamp current level. Thus, the driving signals with shorter pulse widths result in higher lamp current crest factors and lower lamp lighting efficiency.

SUMMARY OF THE INVENTION

One embodiment of the present invention is a power conversion circuit with an input stage voltage regulator (or a pre-regulator) to maintain a substantially constant and relatively low lamp current crest factor for improving operation of a fluorescent lamp under various operating conditions. The pre-regulator can compensate for input voltage variations or adjust the brightness of the fluorescent lamp without significantly altering the lamp current crest factor from a desirable level. Lamp current crest factor is reduced to provide improved lamp operation.

In one embodiment, the power conversion circuit includes a direct drive inverter that generates a substantially AC output signal to drive the fluorescent lamp using driving signals of substantially fixed pulse widths. The direct drive inverter includes a direct drive controller, a direct drive network and a secondary network. The direct drive controller provides the driving signals to the direct drive network to produce a substantially AC output voltage at the secondary network. The secondary network is coupled to the fluorescent lamp, such as a CCFL, and the substantially AC output voltage results in a substantially AC current (i.e., lamp current) which flows through the CCFL to illuminate the CCFL. The brightness of the CCFL is affected by the amplitude of a supply voltage and the pulse widths of the driving signals provided to the direct drive network.

In one embodiment, the pulse widths (or the duty cycles) of the driving signals are predetermined for efficient operation of the CCFL. For example, the pulse widths of the driving signals are set for relatively long durations so that the shape of the voltage waveform across a primary winding of a transformer in the direct drive network (or the primary voltage waveform) approaches the shape of a rectangular wave with a relatively long on-time duty cycle. The relatively long on-time duty cycle of the primary voltage waveform corresponds to relatively long durations in which power is coupled to the secondary network and to the CCFL. The difference between the peak lamp current level and the RMS lamp current level is reduced, thus reducing the lamp current crest factor for improved lamp lighting efficiency.

Given driving signals with fixed pulse widths, the brightness of the CCFL, which is determined by the RMS lamp current level, can be controlled by controlling the amplitude of the supply voltage provided to the direct drive network. For example, an input voltage to the power conversion circuit is provided to the pre-regulator to generate the supply voltage (or the regulated voltage) for the direct drive network. The pre-regulator can provide a predetermined average supply voltage level over a wide input voltage range to maintain substantially constant lamp brightness over the wide input voltage range. The pre-regulator can also adjust the average supply voltage level to vary the brightness (or to provide dimming) of the CCFL.

Furthermore, the pre-regulator can provide a supply voltage with a predefined level of ripple voltage to further improve the lamp current crest factor. For example, a relatively high level of ripple voltage in the supply voltage can reduce the lamp current crest factor to less than the crest factor of a sine wave. Thus, the pre-regulator allows the power conversion circuit to operate over a wide input voltage range and a wide dimming range with predetermined driving signal pulse widths for improving lamp efficiency.

In one embodiment, the power conversion circuit uses a buck/direct drive circuit topology to improve lamp efficiency and to reduce lamp current crest factor variation with varying input voltage levels or brightness levels. The pre-regulator is a buck regulator which efficiently steps down (or reduces) a wide range of input voltages to a predetermined supply voltage for the direct drive network. In one embodiment, the buck regulator operates synchronously with the direct drive inverter. The buck regulator can have an operating frequency that is a multiple of the operating frequency of the direct drive inverter.

The buck regulator includes at least one semiconductor switch, a buck regulator controller and an output filter. In one embodiment, the input voltage is provided to a pair of switching transistors coupled in series between the input voltage and ground. The buck regulator controller uses pulse width modulation techniques to provide control signals to the switching transistors to generate a desired voltage at a common node (or an output) of the switching transistors. The buck regulator can vary the pulse widths of the control signals to compensate for variations in the input voltage or in response to a difference between a brightness control signal and a feedback signal indicative of the lamp current level. In one embodiment, the output of the switching transistors is coupled to the output filter which is designed to produce the predetermined supply voltage with a desired level of ripple voltage. The output filter advantageously uses relatively low cost and small components to provide a relatively high level of ripple voltage in the supply voltage, which, as discussed above, reduces the lamp crest factor.

In another embodiment, the power conversion circuit uses a boost/direct drive circuit topology to improve lamp efficiency and to reduce lamp current crest factor variation with varying input voltage levels or brightness levels. The pre-regulator is a boost regulator which efficiently steps up (or increases) a wide range of input voltages to a predetermined supply voltage for the direct drive network. In one embodiment, the boost regulator operates synchronously with the direct drive inverter. The boost regulator can have an operating frequency that is a multiple of the operating frequency of the direct drive inverter.

In one embodiment, the boost regulator includes at least one semiconductor switch, a boost regulator controller, an input inductor and an output capacitor. In one embodiment, the input voltage is provided to the input inductor coupled in series with a switching transistor to ground. The output capacitor and a series-connected isolation diode or a series-connected isolation switch are coupled in parallel with the switching transistor. The boost regulator controller uses pulse width modulation techniques to provide a control signal to the switching transistor to control the storage of electrical energy in the input inductor and to control the transfer of the electrical energy to the output capacitor. The boost regulator controller operates to achieve a desired voltage across the output capacitor, which is the output of the boost regulator. For example, the boost regulator controller can vary the pulse width of the control signal to compensate for variations in the input voltage or in response to a difference between a brightness control signal and a feedback signal indicative of the lamp current level. The boost regulator controller advantageously works at relatively low voltage levels as the switching transistor is referenced to a relatively low voltage potential. The output capacitor is advantageously a relatively low cost and small component to provide a relatively high level of ripple voltage in the supply voltage, which, as discussed above, reduces the lamp crest factor.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage of group of advantages as taught herein without necessarily achieving other advantages as may be taught or suggested herein.

DETAILED DESCRIPTION OF THE INVENTION

Figure 1:
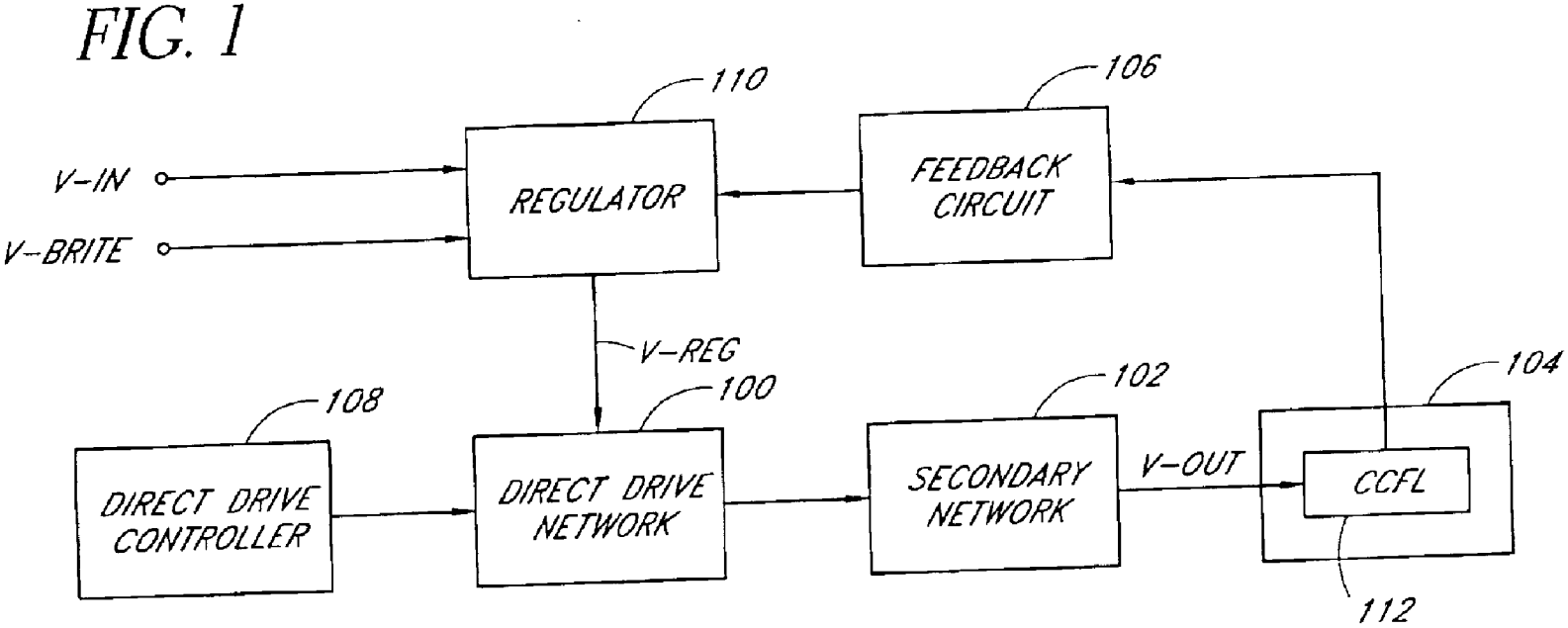
FIG. 1 is a block diagram of a power conversion circuit according to one embodiment of the present invention.

Various embodiments of the present invention will be described hereinafter with reference to the drawings. FIG. 1 is a block diagram of a power conversion circuit according to one embodiment of the present invention. The power conversion circuit converts a substantially DC input voltage (V-IN) into a substantially AC output voltage (V-OUT) to drive a CCFL 112. An AC current (or a lamp current) flows through the CCFL 112 to provide illumination in an electronic device 104, such as, for example, a flat panel display, a personal digital assistant, a palm top computer, a scanner, a facsimile machine, a copier, or the like.

The power conversion circuit includes a regulator 110, a direct drive controller 108, a direct drive network 100, a secondary network 102 and a feedback circuit 106. The regulator (or the input stage voltage regulator or the pre-regulator) 110 accepts the input voltage, a brightness control signal (V-BRITE) and a feedback signal from the feedback circuit 106 to produce a regulated voltage (V-REG). The regulated voltage (or the supply voltage) is provided to the direct drive network 100. The direct drive network 100 is controlled by driving signals provided by the direct drive controller 108. The secondary network 102 is coupled to the direct drive network 100 and produces the output voltage to drive the CCFL 112. The feedback circuit 106 is coupled to the CCFL 112 and generates the feedback signal for the pre-regulator 110.

In one embodiment, the root mean square (RMS) level of the lamp current determines the brightness of the CCFL 112. The RMS lamp current level is a function of the regulated voltage level and pulse widths of the driving signals from the direct drive controller 108. For example, the pulse widths (or the duty cycles) of the driving signals or the regulated voltage level can be varied to vary the RMS lamp current level, thereby controlling the brightness of the CCFL 112.

In one embodiment, the pulse widths of the driving signals are fixed to improve lamp efficiency. One measure of lamp efficiency is the lamp current crest factor, which is defined as a ratio-of the peak lamp current level to the RMS lamp current level. The lamp current crest factor is improved (e.g., lower) when the driving signals have particular respective pulse widths. Variations from the particular pulse widths cause the lamp current factor to increase, thereby decreasing lamp efficiency. Thus, the pulse widths of the respective driving signals can be predefined to improve the lamp current crest factor in an embodiment of the invention.

The pre-regulator 110 is inserted between the input voltage and the direct drive network 100 to facilitate improved lamp efficiency for operation over a wide input voltage range and various brightness settings. For example, the input voltage can be provided by a battery that varies over a wide range during operation, such as from 28 volts to 6 volts. The pre-regulator 110 can maintain a substantially constant average regulated voltage over the wide input voltage range to facilitate consistent illumination without altering the pulse widths of the driving signals to the direct drive network 100.

In one embodiment, the feedback circuit 106 is a current sensing circuit. The feedback circuit 106 detects the lamp current and provides an indication of the lamp current level to the pre-regulator 110. Based on the lamp current level and the brightness control signal, the pre-regulator 110 may adjust the regulated voltage to achieve a desired brightness for the CCFL 112. For example, the pre-regulator 110 can increase the average regulated voltage level to increase brightness or decrease the average regulated voltage level to provide dimming of the CCFL 112 while the pulse widths of the driving signals remain substantially the same.

In one embodiment, the pre-regulator 110 can provide a regulated voltage with a predetermined level of voltage ripples to further improve lamp lighting efficiency. For example, relatively high levels of voltage ripples in the regulated voltage decrease the lamp current crest factor for more efficient operation of the CCFL 112. The ripple voltage level may be greater than 5% of the average amplitude of the regulated voltage. In one embodiment, the ripple voltage level is about 20% of the average amplitude of the regulated voltage. The frequency of the voltage ripples may be a multiple of the frequency of the driving signals, for example, twice the frequency.

The output of the pre-regulator 110 is advantageously coupled to the direct drive network 100. The direct drive network 100 includes a plurality of switching transistors and a primary winding of a transformer, which also has a secondary winding. The control node (e.g., the gate) of each transistor is coupled to the direct drive controller 108 to allow the direct drive controller 108 to control the switching of each transistor with the driving signals. The primary winding of the transformer generally operates as an inductive circuit with some parasitic capacitance. The outputs of the transistors are coupled directly to the primary winding without using any inductors and capacitors to tune the direct drive network 100 to the operating frequency of the direct drive controller 108.

The primary winding of the direct drive network 100 is magnetically coupled through a permeable core to a secondary network 102. The secondary network 102 includes the secondary winding of the transformer, a reactive circuit element and a connector coupled to the CCFL 112.

The direct drive topology advantageously facilitates lamp current crest factors that can be better (i.e., lower) than the crest factor of a pure sine wave. The direct drive topology eliminates resonant components and drives the transformer directly with rectangular wave voltage driving signals. The direct drive topology also does not need a relatively high impedance ballast capacitor, which would contribute to power loss.

Figure 2A:
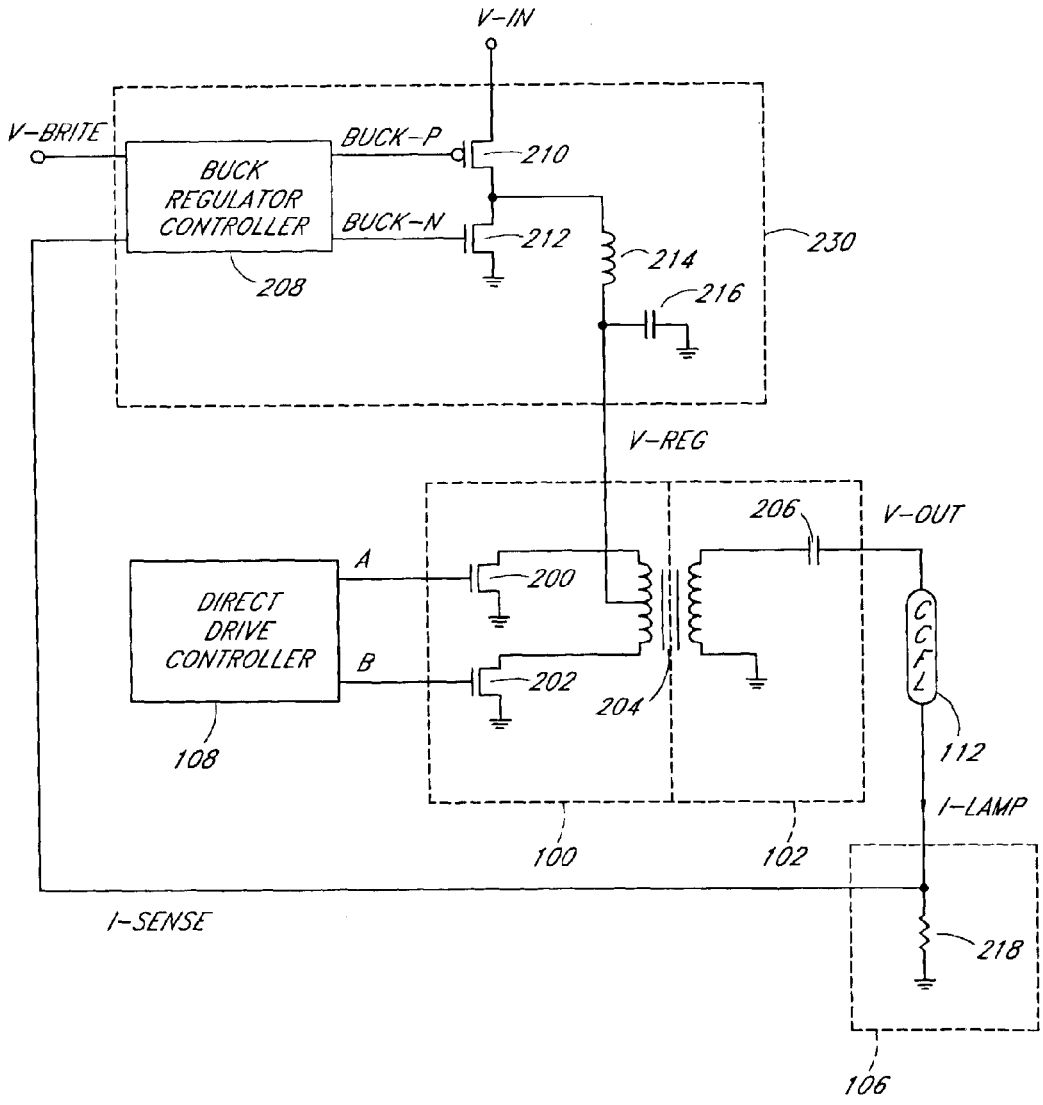
FIG. 2A is a circuit diagram of one embodiment of the power conversion circuit shown in FIG. 1.

FIG. 2A is a circuit diagram of one embodiment of the power conversion circuit shown in FIG. 1. In this embodiment, the pre-regulator 110 is a buck voltage regulator (or a buck converter or a step down converter) 230 which accepts the input voltage (V-IN) and provides the regulated voltage (V-REG) to the direct drive network 100. The direct drive network 100 is controlled by two driving signals (A and B) provided by the direct drive controller 108 and works with the secondary network 102 to provide the output voltage (V-OUT) to the CCFL 112. The feedback circuit 106 is a current sensing circuit coupled in series with the CCFL 112 to provide a feedback signal (I-SENSE) indicative of the lamp current (I-LAMP) to the buck voltage regulator 230. The buck voltage regulator 230 also receives the brightness control signal (V-BRITE) to facilitate dimming of the CCFL 112.

In one embodiment, the buck voltage regulator 230 includes a buck regulator controller 208, switching transistors 210, 212 and an output filter. The brightness control signal and the feedback voltage are provided as inputs to the buck regulator controller 208. The buck regulator controller 208 uses pulse width modulation (PWM) techniques to generate control signals (BUCK-P, BUCK-N) to control the switching transistors 210, 212 respectively. For example, the control signals are provided to gate terminals of the respective switching transistors 210, 212. The first switching transistor 210 is a p-type field-effect-transistor (P-FET) with a source terminal coupled to the input voltage and a drain terminal coupled to an output terminal. The second switching transistor 212 is a n-type FET (N-FET) with a drain terminal coupled to the output terminal and a source terminal coupled to ground. In one embodiment, the output filter is an LC circuit that includes an inductor 214 and a capacitor 216. The inductor 214 is coupled between the output terminal and the output of the buck voltage regulator 230. The capacitor 216 is coupled between the output of the buck voltage regulator 230 and ground.

The regulated voltage at the output of the buck voltage regulator 230 is provided to the direct drive network 100. The direct drive network 100 includes switching transistors 200, 202 and a primary winding of a transformer 204. In one embodiment, the regulated voltage is provided to a center-tap of the primary winding of the transformer 204. The switching transistors are coupled to respective opposite terminals of the primary winding of the transformer 204 to alternately switch the respective terminals to ground. For example, the third switching transistor 200 is a N-FET with a drain terminal coupled to a first terminal of the primary winding of the transformer 204 and a source terminal coupled to ground. The fourth switching transistor 202 is a N-FET with a drain terminal coupled to a second terminal of the primary winding of the transformer 204 and a source terminal coupled to ground. The switching transistors 200, 202 are controlled by the respective driving signals (A, B) which are coupled to gate terminals of the respective switching transistors 200, 202.

An AC signal on the primary winding results from alternating conduction by the switching transistors 200, 202. The AC signal is magnetically coupled to a secondary winding of the transformer 204 in the secondary network 102, which also includes a DC blocking capacitor 206. A first terminal of the secondary winding of the transformer 204 is coupled to ground while a second terminal of the secondary winding is coupled to a first terminal of the blocking capacitor 206. The second terminal of the blocking capacitor 206 is coupled to a first terminal of the CCFL 112.

A second terminal of the CCFL 112 is coupled to the feedback circuit 106. In one embodiment, the feedback circuit 106 includes a sensing resistor 218 coupled between the second terminal of the CCFL 112 and ground. The lamp current substantially flows through the sensing resistor 218, and the voltage across the sensing resistor 218 is provided as the feedback signal (I-SENSE) to the buck regulator controller 208 to indicate the lamp current level.

Alternately, the feedback circuit 106 can be coupled to the secondary network 102 to generate a feedback signal indicative of the operating conditions of the CCFL 112. For example, the sensing resistor 218 can be inserted between the first terminal of the secondary winding and ground to generate a feedback signal indicative of the lamp current level.

The buck voltage regulator 230 improves lamp efficiency in the power conversion circuit while compensating for input voltage fluctuations and providing dimming control of the CCFL 112. The buck voltage regulator 230, with the pair of switching transistors 210, 212 controlled by the control signals (BUCK-P, BUCK-N) provided by the buck regulator controller 208, steps down the input voltage efficiently. For example, the pulse widths (or the duty cycles) of the PWM signals are adjusted to maintain an average regulated voltage level of approximately 5 volts at the center-tap of the primary winding of the transformer 204 for an input voltage range of 6 volts to 28 volts.

The average level of the regulated voltage (or the supply voltage or the center-tap voltage) can also be adjusted to change the brightness (or the light intensity) of the CCFL 112. For example, the buck regulator controller 208 compares the brightness control signal (V-BRITE) with the feedback signal (I-SENSE) and alters the duty cycles of the control signals (or the PWM signals) to adjust the average level of the regulated voltage (V-REG) to achieve a desired brightness. An increase in the on-time duty cycles of the PWM signals increases the average regulated voltage level while a decrease in the on-time duty cycles of the PWM signals decrease the average regulated voltage level. In one embodiment, the average level of the regulated voltage at the output of the buck voltage regulator 230 is lower than the lowest input voltage level for a desired range of lamp brightness (or a dimming range) and is relatively independent of the input voltage level under normal operating conditions.

The lamp current level, and thus the brightness of the CCFL 112, is a function of the regulated voltage level and the duty cycles of the driving signals (A, B). The ability of the buck voltage regulator 230 to accommodate input voltage variations and to provide dimming control allows the power conversion circuit to use driving signals with predetermined pulse widths for improved lamp efficiency (or a relatively low lamp current crest factor). For a given loading condition (or a desired lamp current level) and a given supply voltage, a particular pulse width for the driving signals may yield an improved lighting efficiency. For example, the pulse widths of the respective driving signals are set for relatively long durations to reduce a difference between the peak lamp current and the RMS lamp current to yield a relatively low lamp current crest factor.

Furthermore, the output filter of the buck voltage regulator 230 (e.g., the inductor 214 and the capacitor 216) advantageously provides a desired level of ripple voltage in the regulated voltage to further improve the lamp efficiency. For example, the values of the inductor 214 and the capacitor 216 are advantageously selected to provide a ripple voltage that is approximately +/−20% of the average value of the regulated voltage to improve the lamp current crest factor to be less than approximately 1.3, which is lower than the crest factor of a sine wave. The allowance for a relatively high level of ripple voltage advantageously reduces the size, cost and power dissipation of components in the output filter (or the LC filter) of the buck voltage regulator 230. For example, the inductor 214 can be 10 microhenries and the capacitor 216 can be 1 microfarads. In contrast, a filter design that may not tolerate relatively high levels of ripple voltage may require a capacitor having a capacitance of 100–220 microfarads.

In one embodiment, the buck regulator controller 208 operates synchronously with the direct drive controller 108. For example, the frequency of the control signals (BUCK-P, BUCK-N) provided by the buck regulator controller 208 is a multiple of the frequency of the frequency of the driving signals (A, B) provided by the direct drive controller 108. In one embodiment, the frequency of the control signals is an even multiple of the frequency of the driving signals. The control signals may be in phase or out of phase with the driving signals. The buck regulator controller and the direct drive controller can be realized on one integrated circuit.

The direct drive circuit topology advantageously couples the switching transistors 200, 202 to the primary winding of the transformer 204 without using any tuning inductors and capacitors for frequency adjustments. The switching transistors 200, 202 are controlled by rectangular wave voltage driving signals of a fixed frequency and a fixed duty cycle. Circuit topologies with resonant components, such as a Royer oscillating circuit, generally cannot achieve a lamp current crest factor better than the crest factor of a sine wave.

The lack of resonant components in the direct drive circuit topology allows the lamp current crest factor to be better (i.e., lower) than the crest factor of a pure sine wave. For example, the crest factor of a pure sine wave is approximately 1.414. The buck/direct drive topology of the present power conversion circuit can produce a lamp current crest factor between 1.2 and 1.3 over a wide input voltage range and a wide range of brightness levels. The lower lamp current crest factor typically improves light efficiency by approximately 15% over a sine wave.

Figure 2B:
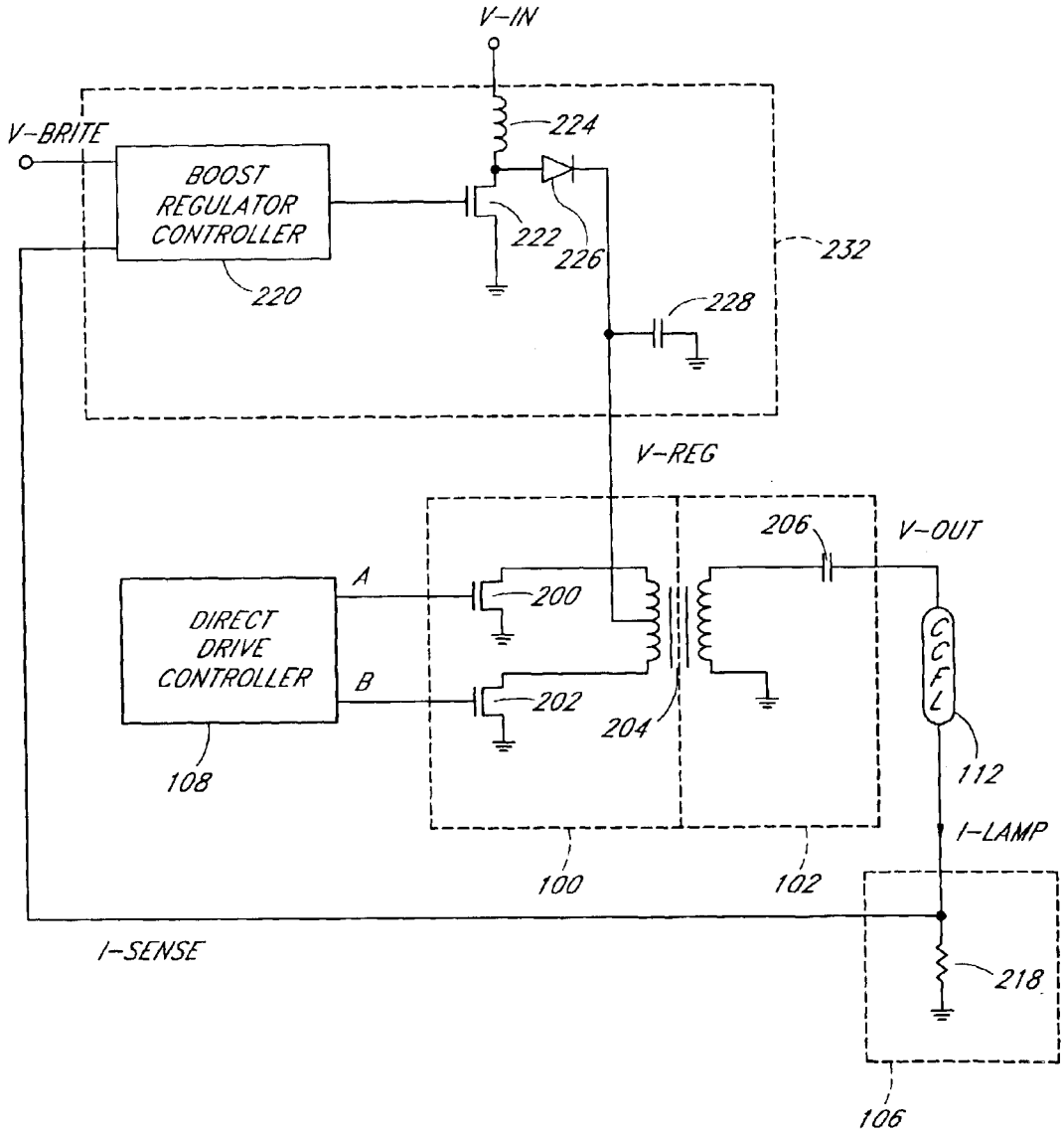
FIG. 2B is a circuit diagram of another embodiment of the power conversion circuit shown in FIG. 1.

FIG. 2B is a circuit diagram of another embodiment of the power conversion circuit shown in FIG. 1. The pre-regulator 110 is a boost voltage regulator (or a boost converter or a step up converter) 232 which accepts the input voltage (V-IN) and provides the regulated voltage (V-REG) to the direct drive network 100. Aside from the boost voltage regulator 232, other components shown in FIG. 2B are substantially similar to corresponding components shown in FIG. 2A and are not discussed in further detail.

In one embodiment, the boost voltage regulator 232 includes a boost regulator controller 220, an input inductor 224, a switching transistor 222, an isolation diode 226 and an output capacitor 228. The input voltage is provided to the input inductor 224 coupled in series with the switching transistor 222 to ground. An anode of the isolation diode 226 is coupled to a common node of the switching transistor 222 and the input inductor 224. A cathode of the isolation diode 226 is coupled to an output of the boost voltage regulator 232. The output capacitor 228 is coupled between the output of the boost voltage regulator 232 and ground. The boost regulator controller 220 receives a brightness control signal (V-BRITE) and a feedback signal (I-SENSE) and outputs a variable pulse width control signal to control the switching transistor 222.

The boost regulator controller 220 uses PWM techniques to adjust the duty cycle of the control signal to the switching transistor 222, thereby controlling the storage of electrical energy in the input inductor 224 and controlling the transfer of the electrical energy to the output capacitor 228. For example, current conducted by the input inductor 224 increases when the switching transistor 222 is on. When the switching transistor 222 is off, the current conducted by the input inductor 224 is provided to the output capacitor 228 and the output of the boost voltage regulator 232 via the isolation diode 226.

The boost regulator controller 220 operates to achieve and to maintain a desired voltage at the output of the boost voltage regulator 232. For example, the boost regulator controller 220 varies the pulse width of the control signal to compensate for variations in the input voltage or in response to a difference between the brightness control signal and the feedback signal indicative of the lamp current level. In addition to benefits discussed above with respect to the buck voltage regulator 230, the boost voltage regulator 232 advantageously employs a boost regulator controller 220 that can work at relatively low voltage levels because the switching transistor 222 is referenced to a relatively low voltage potential. The output capacitor 228 is advantageously a relatively low cost and small component to provide a relatively high level of ripple voltage in the regulated voltage, which, as discussed above, reduces the lamp crest factor.

Figure 3:
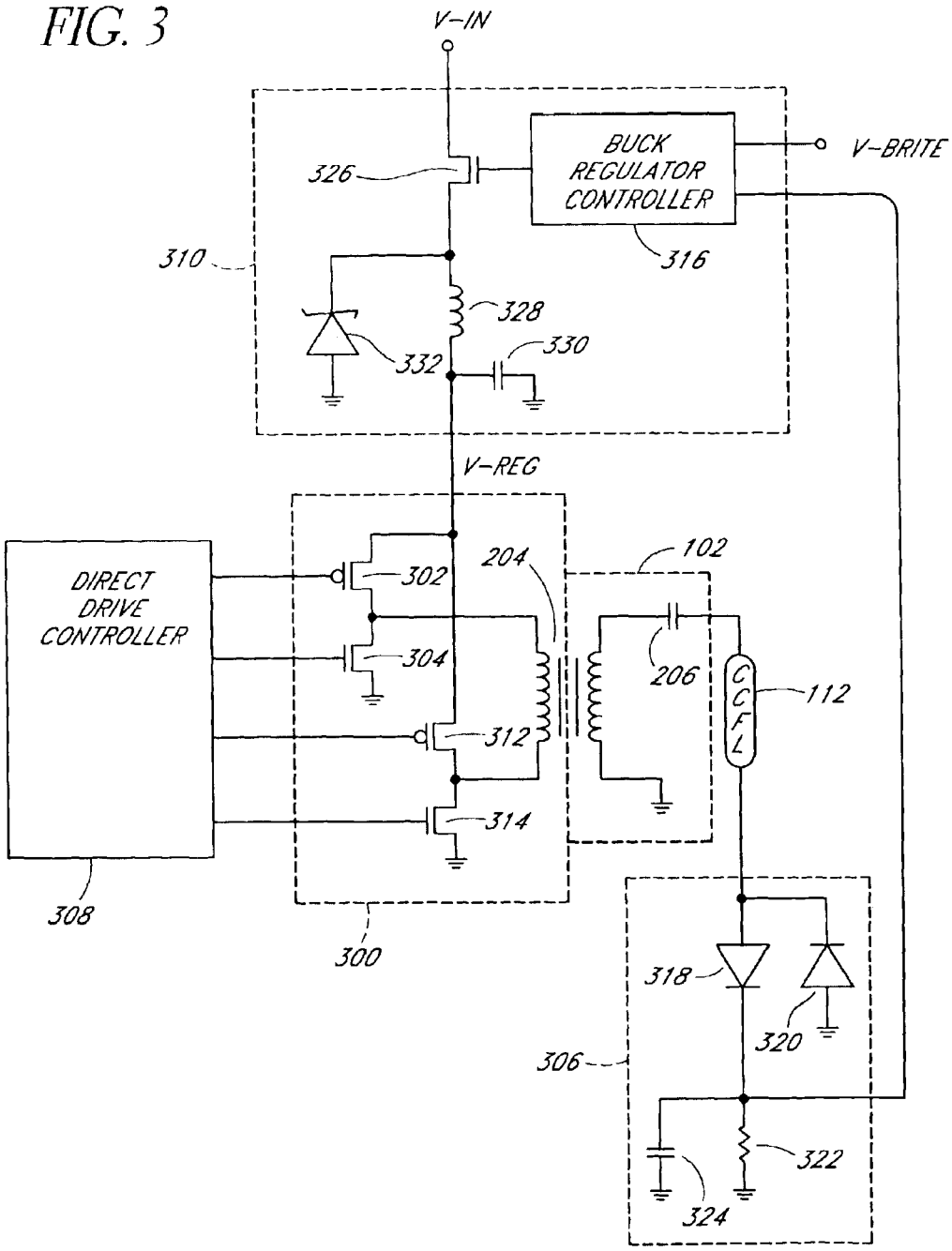
FIG. 3 illustrates alternate embodiments for circuits shown in FIG. 2A.

FIG. 3 illustrates alternate embodiments for circuits shown in FIG. 2A. The power conversion circuit of FIG. 3 illustrates an alternate embodiment of a buck regulator 310 which accepts an input voltage (V-IN) and provides a regulated voltage (V-REG) to an alternate embodiment of a direct drive network 300. The direct drive network 300 is controlled by four driving signals from a direct drive controller 308 and is coupled to a secondary network 102. The secondary network 102 provides an output voltage (V-OUT) to a CCFL 112. An alternate embodiment of a feedback circuit 306 is coupled in series with the CCFL 112 to sense the current (i.e., the lamp current) flowing through the CCFL 112. The feedback circuit 306 generates a feedback voltage that is provided to the buck regulator 310. The buck regulator 310 also receives a brightness control signal (V-BRITE).

The buck regulator 310 includes a primary switch (e.g., a semiconductor switch) 326 coupled between the input voltage and an intermediate node. A cathode of a diode (e.g., a rectifying diode or a zener diode) 332 is also coupled to the intermediate node. An anode of the diode 332 is coupled to ground. An inductor 328 is coupled between the intermediate node and an output of the buck regulator 310. A capacitor 330 is coupled between the output of the buck regulator 310 and ground. A buck regulator controller 316 receives the brightness control signal and the feedback signal and outputs a variable pulse width control signal to control the primary switch 326.

The buck regulator 310 functions substantially similar to the buck regulator 230 of FIG. 2A to provide the regulated voltage to the direct drive network 300. The buck regulator 310 controls the duty cycle of the control signal to the primary switch to control the current flowing through the inductor 328, thus controlling the regulated voltage level. Current flows through the inductor 328 from the input voltage when the primary switch 326 is closed and from the diode 332 when the primary switch 326 is opened. For improved lamp lighting efficiency, the value of the capacitor 330 is designed to be relatively small to provide a relatively high level of ripple voltage in the regulated voltage.

The regulated voltage is provided to switching transistors 302, 312 in the direct drive network 300. The switching transistors 302, 312 are P-FETs with source terminals coupled to the regulated voltage and drain terminals coupled to respective opposite terminals of a primary winding of a transformer 204. The drain terminals of the switching transistors 302, 312 are also coupled to respective drain terminals of switching transistors 304, 314 which are N-FETs. The source terminals of the switching transistors 304, 314 are coupled to ground. The gate terminals of the switching transistors 302, 304, 312, 314 are controlled by the respective driving signals from the direct drive controller 308 to produce a transformer drive signal on the primary winding of the transformer 204.

Other configurations to couple the input voltage and the switching transistors to the primary winding of the transformer 204 may be used to produce the transformer drive signal. The transformer drive signal is magnetically coupled to a secondary winding of the transformer 204 in the secondary network 102. One terminal of the secondary winding is coupled to ground while the other terminal is coupled to a first terminal of the DC blocking capacitor 206. A second terminal of the DC blocking capacitor 206 is coupled to the CCFL 112.

A current sensor 322 in the feedback circuit 306 is coupled in series with the CCFL 112 to provide an indication of the lamp current to the buck regulator 310. The feedback circuit 306 can include diodes 318, 320, the current sensor (resistor) 322 and a capacitor 324. The CCFL 112 is coupled to an anode of the diode 318 and a cathode of the diode 320. An anode of the diode 320 is coupled to ground. A cathode of the diode 318 is coupled to a first terminal of the resistor 322. A second terminal of the resistor 322 is coupled to ground. The capacitor 324 is coupled in parallel with the resistor 322.

The current flowing through the resistor 322 causes a sense voltage across the resistor 322. The sense voltage is provided to the buck regulator controller 316. The diode 318 operates as a half-wave rectifier such the sense voltage that develops across the resistor 322 is responsive to the lamp current passing through the CCFL 112 in one direction. The diode 320 provides a current path for the alternate half-cycles when the lamp current flows in another direction. The capacitor 324 provides filtering such that the sense voltage indicates an average level of the lamp current.

Figure 4:
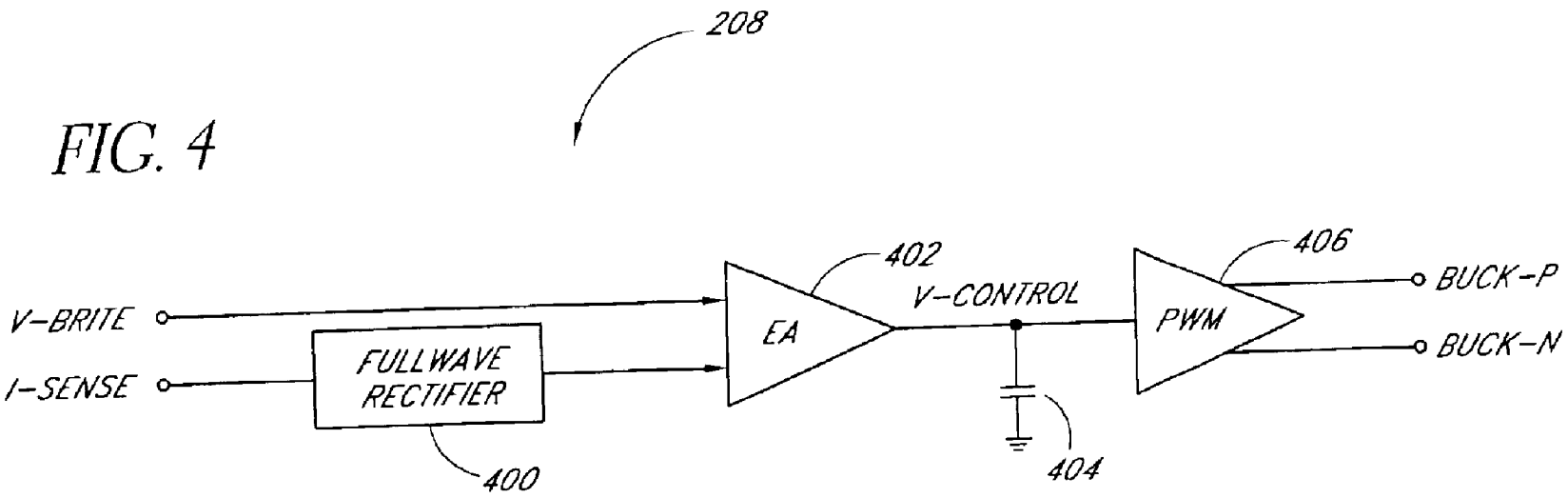
FIG. 4 is a block diagram of one embodiment of a buck regulator controller shown in FIG. 2A.

FIG. 4 is a block diagram of one embodiment of the buck regulator controller 208 shown in FIG. 2A. The buck regulator controller 208 uses PWM techniques and includes a full-wave rectifier 400, an error amplifier (EA) 402, a compensation capacitor 404 and a pulse width modulation (PWM) circuit 406. The full-wave rectifier 400 receives the feedback signal (I-SENSE) indicative of the lamp current and provides an output to the error amplifier 402. In addition to the output from the full-wave rectifier 400, the error amplifier 402 receives the brightness control signal (V-BRITE). The error amplifier 402 outputs an error current responsive to the difference between the rectified feedback signal and the control signal. The compensation capacitor 404 is coupled between the output of the error amplifier 402 and ground to generate a PWM control voltage (V-CONTROL) for the PWM circuit 406. The PWM circuit 406 generates the control signals (BUCK-P, BUCK-N) for the switching transistors 210, 212 shown in FIG. 2A.

In one embodiment, the error amplifier 402 is a transconductance amplifier which outputs a current based on a difference between the brightness control signal and the rectified feedback signal indicative of the lamp current. The compensation capacitor (or smoothing filter) 404 generates the PWM control voltage in response the output current from the error amplifier 402. The value of the compensation capacitor 404 may advantageously be adjusted to vary the speed at which the power conversion circuit responds to changes in the brightness control signal. For example, the power conversion circuit responds slowly with a relatively large compensation capacitor 404 and responds relatively faster with a smaller compensation capacitor 404.

The regulated voltage (or the center-tap voltage) provided by the buck regulator 208 may change too fast and may increase too high in the initial stages of operation if the compensation capacitor 404 is too small, causing potential damage to the power conversion circuit. Therefore, a voltage limit circuit (not shown) may advantageously be used to monitor the center-tap voltage. For example, in particular embodiments, the voltage limit circuit advantageously includes a resistor divider coupled to the output of the buck regulator 208 for monitoring the center-tap voltage. If the center-tap voltage is too high, as indicated by an output of the resistor divider exceeding a predefined threshold, the voltage limit circuit decreases the duty cycles of the control voltages to the switching transistors 210, 212 to reduce the center-tap voltage to a safe level.

The control signals at the respective outputs of the PWM circuit 406 are variable duty cycle signals. The PWM control voltage at the input of the PWM circuit 406 is compared with a periodic triangular or a periodic ramp voltage (a periodic reference voltage) to determine the duty cycles or pulse widths of the respective control signals. For example, the control signals are in a first state during the time that the periodic reference voltage is below the PWM control voltage and transition to a second state when the periodic reference voltage is above the PWM control voltage. The duty cycles of the control signals change in proportion to an amplitude change in the PWM control voltage.

In one embodiment, the periodic reference voltage is synchronous with the driving signals from the direct drive controller 108 and may have a frequency that is a multiple of the frequency of the driving signals. Thus, the control signals may be synchronous with the driving signals with a higher frequency. The control signals may be in phase or out of phase with the driving signals.

Figure 5:
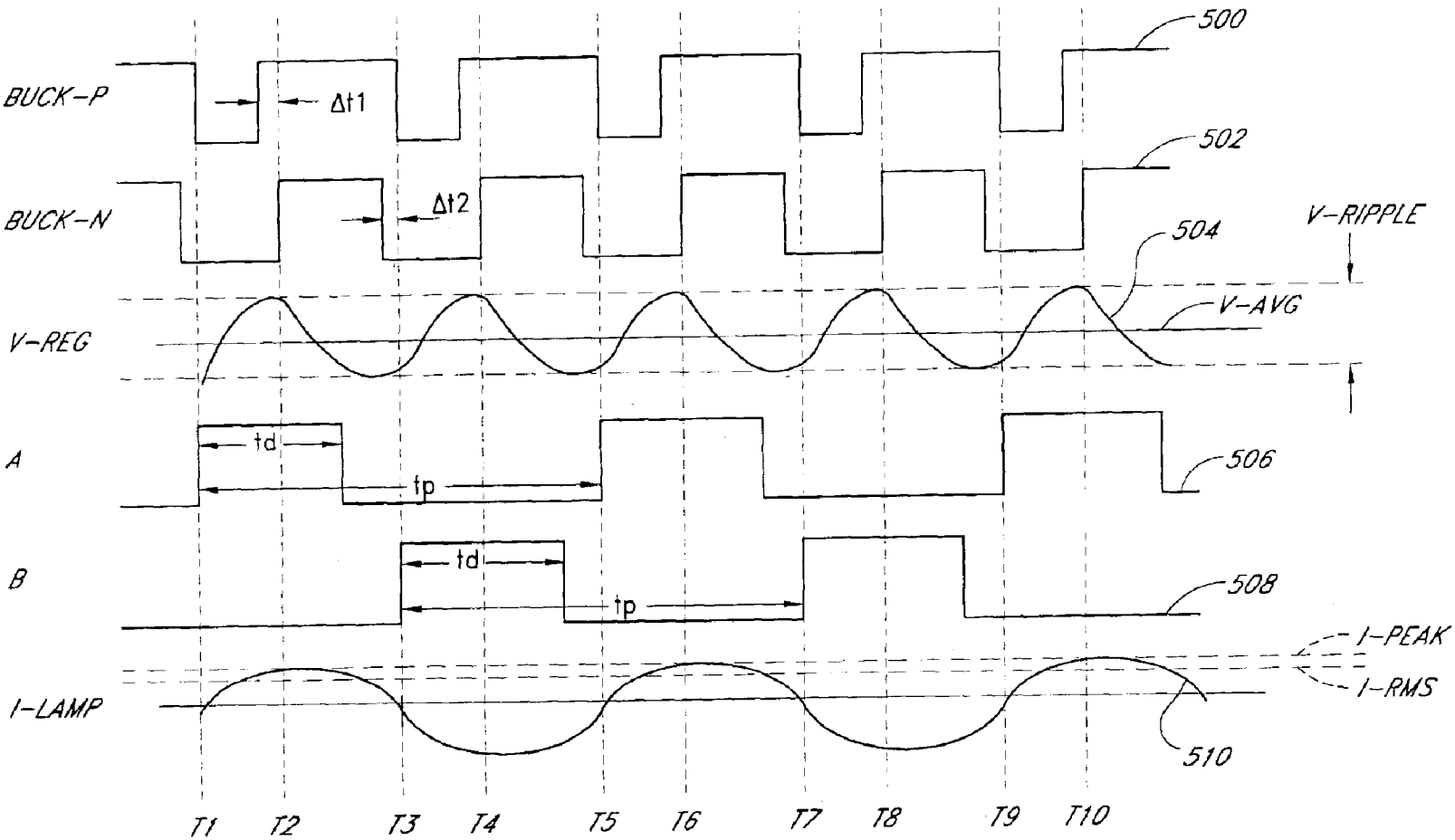
FIG. 5 illustrates timing diagrams that show the waveforms of various signals in the power conversion circuit of FIG. 2A.

FIG. 5 illustrates timing diagrams which show the waveforms of various signals in the power conversion circuit of FIG. 2A. A graph 500 represents a first control voltage (BUCK-P) that is provided to the gate terminal of the switching transistor 210 in the buck regulator 230. A graph 502 represents a second control voltage (BUCK-N) that is provided to the gate terminal of the switching transistor 212 in the buck regulator 230. A graph 504 represents a regulated voltage (V-REG) at the output of the buck regulator 230. A graph 506 represents a first driving voltage (A) that is provided to the gate terminal of the switching transistor 200 in the direct drive network 100. A graph 508 represents a second driving voltage (B) that is provided to the gate terminal of the switching transistor 202 in the direct drive network 100. Finally, a graph 510 represents a lamp current (I-LAMP) flowing through the CCFL 112.

The control voltages (BUCK-P and BUCK-N) are synchronous with the driving voltages and have a higher frequency than the frequency of the driving voltages. In one embodiment, the control voltages are in phase with the driving voltages and have a frequency that is twice the frequency of the driving voltages. For example, at a time T1, the first control voltage (BUCK-P) transitions to a low state to turn on the switching transistor 210 at approximately the same time the first driving voltage (A) transitions to a high state to turn on the switching transistor 200. At a time T3, the first control voltage begins a second cycle of turning on the switching transistor 210 which is substantially aligned with the transition of the second driving voltage (B) to a high state to turn on the switching transistor 202. The first control voltage is synchronized to the driving voltages and goes through two switching cycles for each cycle of the driving voltages.

The second control voltage (BUCK-N) complements or follows the first control voltage so that the switching transistors 210, 212 are turned on alternately. For example, the second control voltage is in a low state when the first control voltage transitions to a low state and transitions to a high state when the first control voltage is in a high state. The low states of the first control voltage turn on the switching transistor 210 while the high states of the second control voltage turn on the switching transistor 212.

To assure that the switching transistors 210, 212 do not inadvertently both conduct at the same time to cause an unintended short circuit, some underlap times ($\Delta t1$, $\Delta t2$) are provided between the transitions of the control voltages. For example, the first control voltage transitions to a high state to turn off the switching transistor 210 for a time ($\Delta t1$) before the second control voltage transitions to a high state to turn on the switching transistor 212. Similarly, the second control voltage transitions to a low state to turn off the switching transistor 212 for a time ($\Delta t2$) before the first control voltage transitions to a low state to turn on the switching transistor 210. In one embodiment, the underlap times are designed to be approximately 100 nanoseconds.

When the switching transistor 210 is on, power is provided by the input voltage to the buck regulator 230, and the regulated voltage at the output of the buck regulator 230 increases. When the switching transistor 210 is off, the buck regulator 230 is cut off from the input voltage, and the regulated voltage decreases. Thus, the regulated voltage rises and falls depending on the conduction state of the switching regulator 210.

The average level (V-AVG) of the regulated voltage is determined by the on-time pulse width of the first control voltage. The level of ripple voltage (V-RIPPLE) in the regulated voltage can be controlled by the output filter of the buck regulator. For example, relatively small component values in the output filter can provide a desired relatively high level of ripple voltage in the regulated voltage for efficient lamp operation. In one embodiment, the RMS level of the regulated voltage is 5 volts and the ripple voltage is 2 volts peak-to-peak. The frequency of the ripple voltage follows the frequency of the control voltages.

In one embodiment, the driving voltages have substantially fixed on-time duty cycles of a relatively long duration (td) to improve lamp lighting efficiency. For example, each of the driving voltages can have an on-time duty cycle greater than 35%, which corresponds to coupling power to the secondary network 102 for greater than 70% of the time. This has the effect of actively driving the CCFL 112 with a greater than 70% duty cycle signal. In one embodiment, each of the driving voltages has a 42% on-time duty cycle. The driving voltages turn on the respective switching transistors 200, 202 for durations (td) that are approximately 42% of the duration of each period (tp). In this case, there is an 8% dead time between the alternating conduction states of the switching transistors 200, 202. The alternating conductions of the switching transistors 200, 202 result in an AC voltage waveform (or primary voltage waveform) across the primary winding of the transformer 204 with power being coupled to the secondary winding of the transformer 204 in the secondary network 102 about 84% of the time. Thus, the AC output voltage of the secondary network 102 for driving the CCFL 112 has an effective duty cycle of approximately 84%.

The AC output voltage causes the lamp current to be an AC signal that flows in one direction (e.g., positive direction) when the switching transistor 200 is conducting and in an opposite direction (e.g., negative direction) when the switching transistor 202 is conducting. Due to the relatively long on-time duty cycles (or pulse widths) of the driving voltages, the lamp current is relatively smooth, and the peak lamp current level (I-PEAK) is relatively close to the RMS lamp current level (I-RMS). Thus, the lamp current crest factor is relatively low, and the lamp lighting efficiency is relatively high.

The relatively high level of ripple voltage in the regulated voltage shapes the lamp current waveform to cause the waveform to approach the shape of a rectangular waveform to further reduce the difference between the peak lamp current level and the RMS lamp current level. In one embodiment, the frequency of the ripple voltage is twice the frequency of the lamp current. The ripple voltage can be in phase with respect to the lamp current or phase shifted with respect to the lamp current.

In one embodiment, a power conversion circuit using a direct drive topology with a pre-regulator (e.g., a boost regulator or a buck regulator) 110 can achieve lamp current crest factors lower (i.e., better) than the crest factor of a pure sine wave. For example, the power conversion circuit can achieve lamp current crest factors between 1.2 to 1.3, which yields approximately 15% more light efficiency in comparison with a lamp current resembling a pure sine wave. The direct drive topology uses relatively fixed pulse width driving signals with relatively long on-time durations. The pre-regulator 110 is synchronized to the driving signals and operates at about twice the frequency of the driving signals. The buck regulator 100 introduces a relatively high ripple voltage (e.g., +/−20%) in the supply voltage to shape the waveform of the lamp current towards the shape of a rectangular waveform. Thus, the peak current level and the RMS current level are closer to each other, thereby reducing the lamp current crest factor. The pre-regulator 110 can also account for a relatively wide range of input voltages and a relatively wide dimming range for the CCFL 112 while maintaining efficient lamp operation.

Although described above in connection with CCFLs, it should be understood that a similar apparatus and method can be used to drive fluorescent lamps having filaments, neon lamps, and the like.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A power conversion circuit for driving a fluorescent lamp, the circuit comprising:

a voltage regulator configured to receive an input voltage and to generate a regulated voltage with a predefined level of ripple voltage; and a direct drive inverter configured to receive the regulated voltage and to generate an alternating current signal to drive the fluorescent lamp using driving signals of substantially fixed pulse widths, wherein the direct drive inverter comprises:

a direct drive network with a plurality of switching transistors configured to couple the regulated voltage to a primary winding of a transformer;

a direct drive controller configured to output the driving signals of substantially fixed pulse widths to control the plurality of switching transistors; and a secondary network with a secondary winding of the transformer configured to output the alternating current signal to drive the fluorescent lamp.

2. The power conversion circuit of claim 1, wherein the input voltage is a substantially DC voltage supplied by a battery.

3. The power conversion circuit of claim 1, wherein the average regulated voltage is substantially constant for a wide range of input voltages.

4. The power conversion circuit of claim 1, wherein the predefined level of ripple voltage is greater than 5% of the average level of the regulated voltage to shape the waveform of the lamp current towards the shape of a rectangular waveform.

5. A power conversion circuit for driving a fluorescent lamp, the circuit comprising:

a voltage regulator configured to receive an input voltage and to generate a regulated voltage with a predefined level of ripple voltage, wherein the voltage regulator is a boost regulator that comprises:

an inductor coupled between the input voltage and an intermediate node;

a semiconductor switch coupled between the intermediate node and ground;

an isolation element coupled between the intermediate node and an output terminal of the boost regulator; and a capacitor coupled between the output terminal of the boost regulator and ground; and a direct drive inverter configured to receive the regulated voltage and to generate an alternating current signal to drive the fluorescent lamp using driving signals of substantially fixed pulse widths.

6. The power conversion circuit of claim 1, wherein the fluorescent lamp is configured to provide illumination in an electronic device, and the electronic device is a flat panel display, a personal digital assistant, a palm top computer, a scanner, a facsimile machine, or a copier.

7. The power conversion circuit of claim 1, wherein the substantially fixed pulse widths of the driving signals correspond to actively driving the fluorescent lamp for greater than 70% of the time.

8. The power conversion circuit of claim 1, further comprising a current sensing circuit configured to detect current flowing through the fluorescent lamp and to provide an indication of the amplitude of the current to the voltage regulator, the voltage regulator controlling the average level of the regulated voltage to control the amplitude of the current to a level that produces a desired brightness for the fluorescent lamp.

9. The power conversion circuit of claim 8, wherein the current sensing circuit is a sensing resistor coupled in series with the fluorescent lamp.

10. A power conversion circuit for driving a fluorescent lamp, the circuit comprising:

a voltage regulator configured to receive an input voltage and to generate a regulated voltage with a predefined level of ripple voltage, wherein the voltage regulator is a buck converter that comprises:

a pair of semiconductor switches coupled in series between the input voltage and ground;

a pulse width modulation controller configured to provide control signals to the pair of semiconductor switches; and an output filter coupled between a common node of the pair of semiconductor switches and an output terminal of the buck converter; and a direct drive inverter configured to receive the regulated voltage and to generate an alternating current signal to drive the fluorescent lamp using driving signals of substantially fixed pulse widths.

11. The power conversion circuit of claim 10, wherein the pulse width modulation controller varies the pulse widths of the control signals to compensate for variations in the input voltage.

12. The power conversion circuit of claim 10, wherein the pulse width modulation controller varies the pulse widths of the control signals in response to comparisons between a brightness control signal and a feedback signal indicative of the lamp current level.

13. The power conversion of claim 10, wherein the pulse width modulation controller comprises:

an error amplifier configured to compare a brightness control signal and a feedback signal indicative of the lamp current level;

a compensation circuit coupled to an output of the error amplifier and configured to generate a control voltage; and a pulse width modulation circuit coupled to the compensation circuit and configured to generate the control signals with pulse widths determined by the level of the control voltage.

14. The power conversion circuit of claim 10, wherein the output filter is designed such that the level of the ripple voltage is approximately 20% of the average amplitude of the regulated voltage.

15. The power conversion circuit of claim 10, wherein the output filter comprises:

an inductor connected between the common node of the pair of semiconductor switches and the output terminal of the buck converter; and a capacitor connected between the output terminal of the buck converter and ground.

16. A method for improving lamp lighting efficiency, comprising the acts of:

supplying an input voltage to a pre-regulator, which generates a regulated voltage with a ripple voltage;

providing the regulated voltage to a center-tap of a primary winding of a transformer;

driving the primary winding of the transformer with fixed duty cycle signals to generate an AC signal in the primary winding of the transformer; and coupling the AC signal in the primary winding to a secondary winding of the transformer to drive a fluorescent lamp, wherein the fluorescent lamp is actively driven for greater than 70% of the time.

17. The method of claim 16, further comprising the acts of:

sensing a current flowing through the fluorescent lamp; and providing an indication of the current level to the pre-regulator to control the regulated voltage level for a desired brightness level.

18. A power conversion circuit for driving a fluorescent lamp with improved efficiency, comprising:

means for receiving a DC voltage and generating a regulated voltage with a predetermined level of ripple voltage;

means for generating an AC output voltage to drive the fluorescent lamp, the output voltage having a wave shape that approaches a wave shape of a rectangular signal and having a frequency that is approximately half of the frequency of the ripple voltage;

means for sensing the level of a lamp current corresponding to the AC output voltage; and means for the adjusting a level of the regulated voltage to produce a desired brightness for the fluorescent lamp.

19. The power conversion circuit of claim 18, wherein the AC output voltage is generated with substantially fixed pulse width driving signals.

20. A power conversion circuit for driving a fluorescent lamp, the circuit comprising:

a voltage regulator configured to receive an input voltage and to generate a regulated voltage with a predefined level of ripple voltage; and a direct drive inverter configured to receive the regulated voltage and to generate an alternating current signal to drive the fluorescent lamp using driving signals of substantially fixed pulse widths, wherein the voltage regulator operates synchronously with the direct drive inverter.

21. The power conversion circuit of claim 20, wherein the voltage regulator has an operating frequency that is twice the operating frequency of the direct drive inverter.

* * * * *